US005743450A

United States Patent [19]

Plate

[11] Patent Number: 5,743,450

[45] Date of Patent: Apr. 28, 1998

[54] SCISSORS RETAINING APPARATUS

[76] Inventor: Scotty Allen Plate, P.O. Box 84, Bath, Ill. 62617

[21] Appl. No.: 760,836

[22] Filed: Dec. 5, 1996

[51] Int. Cl.[6] ..... A45C 3/14

[52] U.S. Cl. ..... 224/220; 224/219; 224/267; 224/250

[58] Field of Search ..... 224/217, 218, 224/219, 220, 221, 222, 250, 367, 904

[56] References Cited

U.S. PATENT DOCUMENTS 2,728,501 12/1955 Hill ..... 224/219
4,239,136 12/1980 Godwin ..... 224/219
5,163,206 11/1992 Hernandez ..... 224/217
5,170,917 12/1992 Tourigny ..... 224/219
5,421,498 6/1995 Menomi ..... 224/220

*Primary Examiner*—Henry L. Recla
*Assistant Examiner*—Gregory M. Vidovich
*Attorney, Agent, or Firm*—Johnson Smith Pence Densborn Wright & Heath

[57] ABSTRACT

A scissor retaining apparatus for retaining a pair of scissors in the event the scissors are dropped by the user to prevent damage to the scissors and to prevent injury to persons standing or sitting nearby. Additional features include a detachable scissor sheath that provides increased safety for those in proximity to the scissors and additional protection for the scissors.

3 Claims, 5 Drawing Sheets

SCISSORS RETAINING APPARATUS

FIELD OF THE INVENTION

The invention relates generally to the design of a scissors retaining apparatus which incorporates a scissors retainer that allows efficient use of the scissors while protecting the scissors from damage and protecting the safety of others.

DESCRIPTION OF THE PRIOR ART

While there are other scissor holders in the prior art, the present invention incorporates improvements that result in increased functionality, ease of use and freedom of movement for the user all in a simplistic design different from that of the prior art.

One example of a prior scissor holding device is disclosed in U.S. Pat. No. 5,421,498 naming Nancy J. Menoni as the inventor. In the aforementioned U.S. Patent, a holster for a hairdresser's scissors is disclosed which incorporates a pocket for retaining a pair of scissors, a strap for retaining the scissors to one of the fingerholds of the scissors and two straps that secure the apparatus to the hairdresser's forearm. There are several disadvantages to this type of scissor holster. There are two straps to secure the device to the forearm which takes more time and effort to attach. Also, the scissor holster is rather large in size and may become a nuisance to the hairdresser. Furthermore, the scissor retaining strap is only attached to one fingerhold of the scissors. The scissors are more difficult to remove from the holster since they are mostly covered by the holster outer flap. Finally, the use of a hook to attach the scissor retaining strap to the fingerhold of the scissors would tend to cause abrasions and discomfort to the finger when inserted.

Another example of a prior device is disclosed in U.S. Pat. No. 1,482,647 naming Allison D. Gise as the inventor. In this U.S. Patent, a pencil holder is disclosed which incorporates a strap which is secured to the wrist and incorporates two openings to accommodate pencils. While this invention relates to a device strapped to a person's wrist for holding an object, the function and design are different from the present invention. The device is designed primarily for pens and pencils and does not include a retaining device for the pens and pencils.

Another example of a prior device is disclosed in U.S. Pat. No. 5,388,740 naming Gordon D. Garland as the inventor. This U.S. Patent discloses a tool holder for fishermen and tradesmen. The tool holder attaches to a person's belt and is used primarily for holding a tool. The device does not include a retaining device for the tool.

Another example of a prior device is disclosed in French Patent No. 590,104 naming M. Jean Henri-Labourdette as the inventor. In this French Patent, an invention is disclosed for use as a pen holder and retaining device. The device is attached by two straps to the forearm and has a chain attached to one of the straps. The other end of the chain is attached to the end of a pen or pencil. However, the design of this invention is significantly different than the present invention. The present invention is much simpler in design and serves a different purpose.

The present invention represents an improvement over the prior art due to the more simplistic design of the apparatus, the ease and comfort of use and the lower anticipated costs of manufacturing the apparatus.

SUMMARY OF THE INVENTION

The primary object of the present invention is to provide a scissor retaining device that is much easier to use, safer and more versatile than previous designs.

Another object of the present invention is to make the aforementioned scissor retaining apparatus in a cost efficient manner.

These objects are accomplished by the present invention, a scissor retaining device, comprising a band of material, a wrist portion at one end of the band for disposing about the wrist of a person, a wrist securing means for securing the wrist portion of the band to the wrist of a person, a retaining strap portion at the opposite end of the band for disposing about the finger holes of a pair of scissors, a retaining strap securing means for securing the retaining strap portion to the finger holes of a pair of scissors, a first piece of triangular material and a second piece of triangular material of a similar shape, joined together to form a sheath for placement over the point of the scissors and secured to the wrist portion and a sheath securing means for securing the sheath to the wrist portion.

BRIEF DESCRIPTION OF DRAWINGS

In order that the invention can be more clearly ascertained, examples of preferred embodiments will now be described with reference to the accompanying drawings.

DESCRIPTION OF PREFERRED EMBODIMENTS

Figure 1:
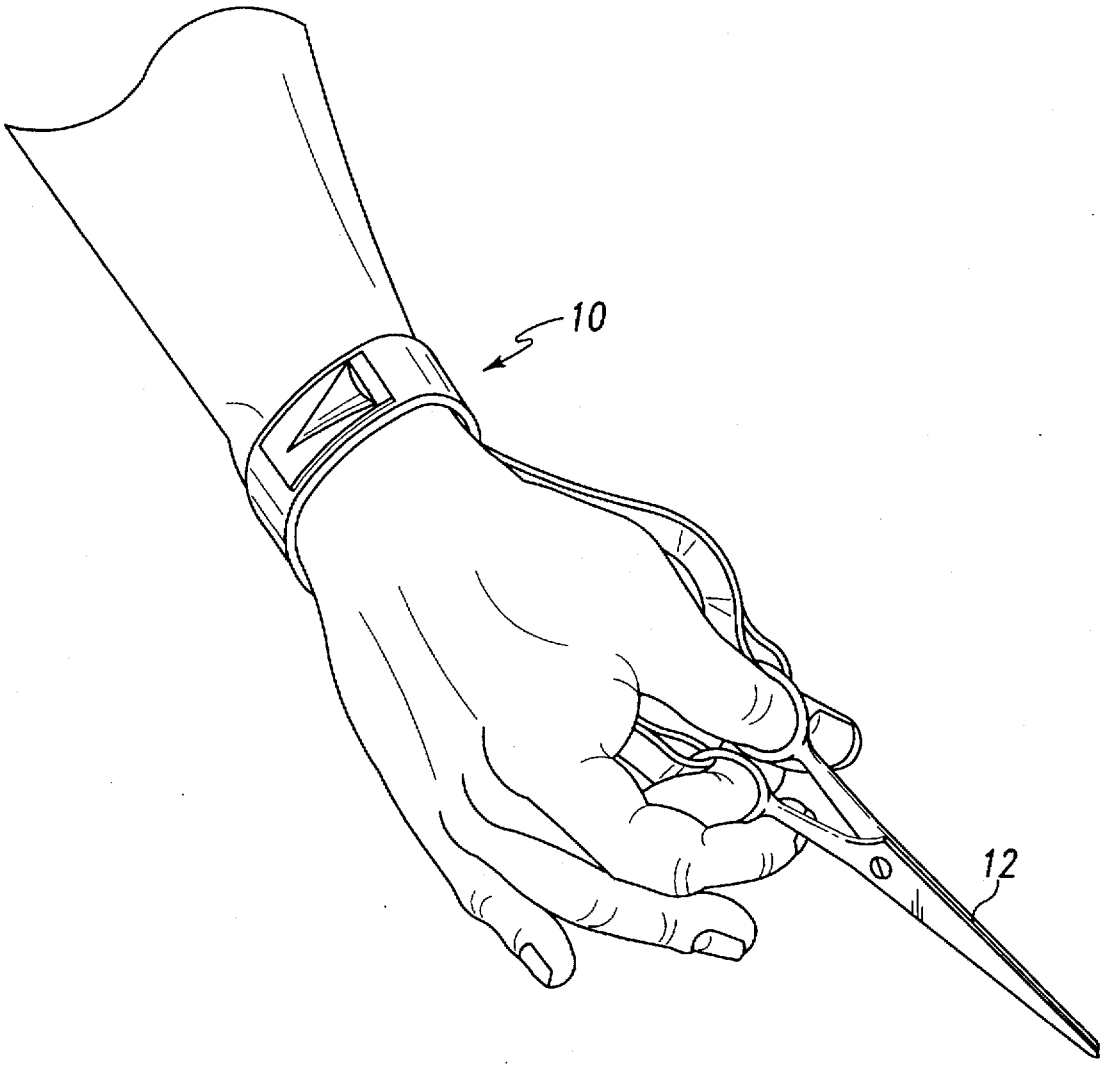
FIG. 1 is a perspective view of the invention mounted on the wrist of a person (not shown).

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a perspective view of the invention mounted on the wrist of a person is shown. This illustration depicts the scissor retaining apparatus or device 10 as used. The wrist portion 14 of the device 10 is secured around the wrist of a wearer and the scissor retaining straps 16 and 18 are secured around each of the two finger holes of the scissors 12 such that the scissors are usable as designed without any interference from the scissor retaining apparatus 10.

Figure 2:
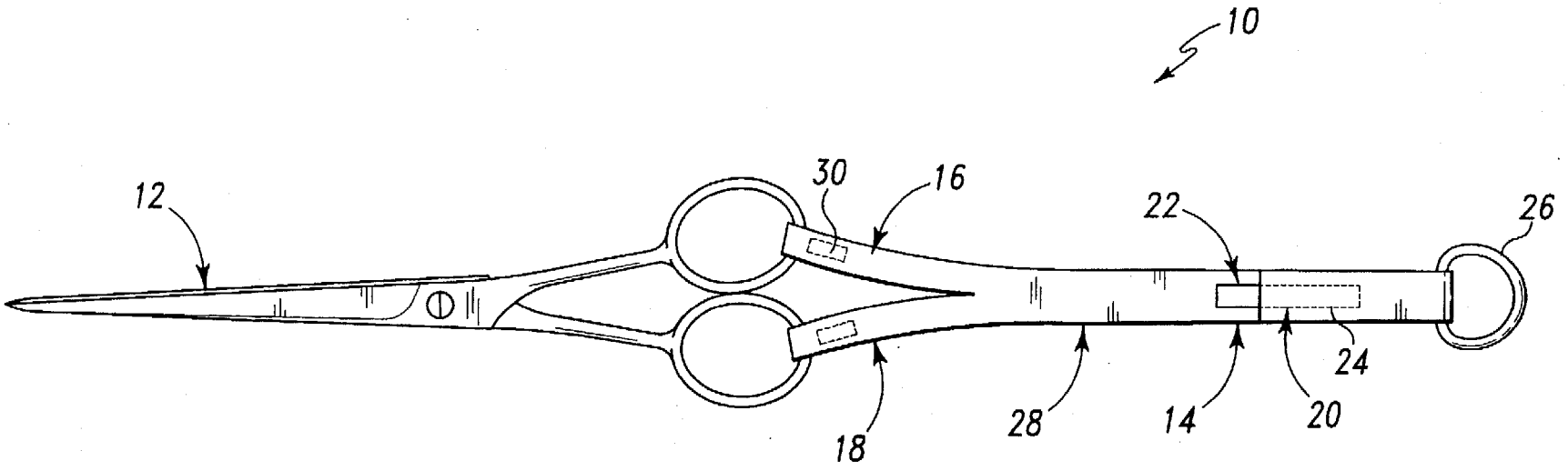
FIG. 2 is a top, plan view of the scissor retaining device with scissors secured to the retaining straps.

Referring now to FIG. 2, a top, plan view of the scissor retaining device 10 with scissors 12 secured to the retaining straps 16 and 18 is shown. The scissor retaining device 10 consists of a single band of material 28 that is slit at one end to form a pair of retaining straps 16 and 18 which are secured separately to each of the finger holes of the scissors 12 by means of a hook and loop assembly 30. In the same fashion, the wrist portion 14 of the scissor retaining device 10 is positioned at the opposite end of the band of material 28 and loops around the wrist and is secured by means of a hook and loop assembly 20. The hook and loop assembly 20 is shown in its secured position and is preferred since it provides the greatest ease of use and flexibility in adjustment. Using this fastening mechanism, the wrist loop portion 22 of the hook and loop assembly 20 is positioned on the wrist portion 14 nearest the loop 26. The loop 26 is attached to the wrist portion 16 by passing the end of the material 28 at the wrist portion 16 through the loop 26 and sewing the end of the material 28 to the wrist portion 14. The loop 26 is most commonly shaped in the form of a D shaped ring and may be made of a variety of metals or metal alloys or plastic material. The loop 26 may vary in size but its width will most normally be slightly wider than the width of the material 28. The wrist hook portion 24 is adjacent to the wrist loop portion 22 on the wrist portion 14 such that the scissor retaining device 10 is positioned on top of the wrist of the wearer and the retaining straps 16 and 18 are then routed through the loop 26 and adjusted to the point where the wrist portion 14 is looped comfortably about the wrist. The wrist loop portion 22 and the wrist hook portion 24 must be attached to wrist portion 14. This may be accomplished by using adhesives or by sewing the wrist loop portion 22 and wrist hook portion 24 to the wrist portion 14. The wrist hook portion 24 is then positioned on top of the wrist loop portion 22 to provide a secure closure and the retaining straps 16 and 18 and the attached scissors 12 are allowed to hang freely. A hook and loop system commonly sold under the Trade VELCRO may be used.

Other means of securing the scissor retaining straps and the wrist portion include a snap closure, a buckle closure or a hook and loop assembly that does not incorporate a loop 26. These alternate securing means are all well known within the art.

Figure 3:
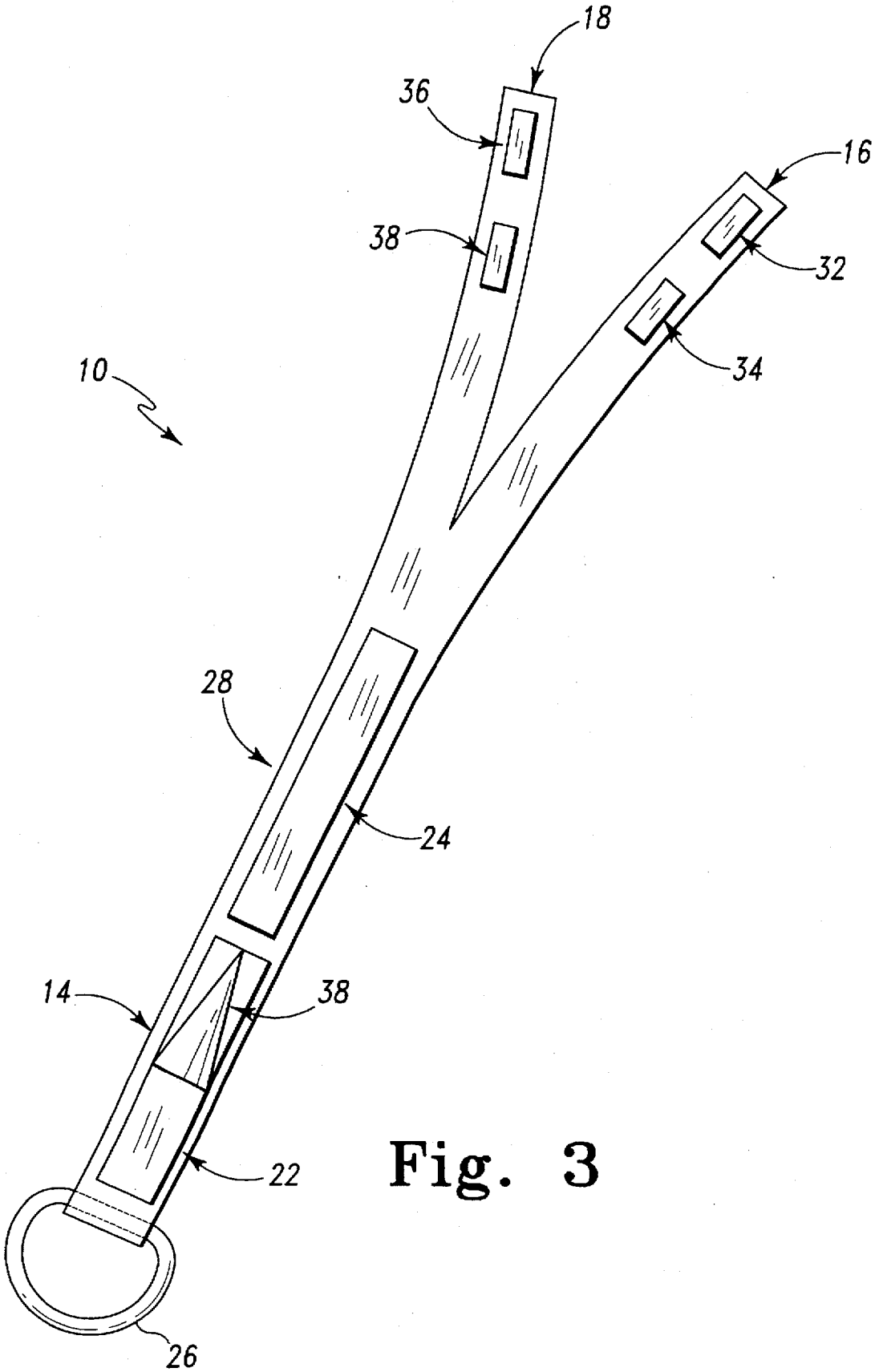
FIG. 3 is a top, plan view of the scissor retaining device with hook and loop assembly.

Referring now to FIG. 3, a top, plan view of the scissor retaining device 10 with hook and loop assembly 20 is shown. The scissor retaining device 10 is made of a band of material 28 which comprises a wrist portion 14 at one end of the scissor retaining device 10 and scissor retaining straps 16 and 18 at the other end of the scissor retaining device 10 opposite the wrist portion 14. The band of material 28 may be made of a piece of resilient or elastic material such as closed cell neoprene foam, in the preferred form, or some other material such as leather or nylon in alternative forms. In the preferred form, the material is covered by a fabric layer such as Nylon Tricot on one or both sides to provide comfort and aesthetic value. The scissor retaining device 10 is secured to a person's wrist by looping the wrist portion 14 around the person's wrist. The wrist portion 14 is routed through a loop 26 and doubled back such that a more controlled securing to the wrist can be accomplished as described in the discussion of FIG. 2. By using the loop 26, the strap can be pulled such that the desired tightness around the wrist is accomplished before the hook and loop assembly 20 is secured. A hook and loop system commonly sold under the Trade VELCRO may be used.

The scissor retaining straps 16 and 18 are secured individually to each of the finger holes in the scissors 12 by means of a hook and loop assembly 30. The scissor retaining strap 16 is routed through one of the finger holes in the scissors 12. The scissor retaining strap 16 comprises a strap loop portion 32 at the end of the scissor retaining strap 16 and a strap hook portion 34 directly adjacent to the strap loop portion 32. The strap loop portion 32 and the strap hook portion 34 must be attached to scissor retaining strap 16. This may be accomplished by using adhesives or by sewing the strap loop portion 32 and strap hook portion 34 to the scissor retaining strap 16. The scissor retaining strap 16 passes through the finger hole such that the strap loop portion 32 is pulled through the finger hole and folded back onto the strap hook portion 34 and a secure closure is attained. The material thickness in the finger holes created from passing the scissor retaining strap 16 through the finger hole provides the added benefit of snugging the person's fingers within the finger holes without causing an undue amount of abrasion or discomfort on the fingers. In a similar manner, scissor retaining strap 18 is also secured about the other fingerhole in the pair of scissors 12. The scissor retaining strap 18 passes through the remaining finger hole such that the strap loop portion 36 is pulled through the finger hole and folded back onto the strap hook portion 38 and a secure closure is attained. The length of the retaining straps may be adjusted by pulling each of the straps through the finger holes until the desired length is reached. The strap loop portions 32 and 36 and the strap hook portions 34 and 38 may be attached along the entire length of the scissor retaining straps 16 and 18 to provide maximum adjustability.

The wrist portion 14 of the scissor retaining device 10 must be of sufficient length to allow for securing to the wrist as well as unrestricted use of the scissors. The wrist portion 14 must also be short enough that if the scissors are dropped there is as little freedom of movement as necessary in order to prevent the scissors from striking the floor or to decrease the risk of striking another person standing or sitting nearby. Consequently, the scissor retaining device 10 may be 13 to 18 inches in length with the most common length being 15 to 16 inches in order to provide the proper length for the wrist portion 14. The length depends on the size of the person's wrist. The design of this device provides additional safety due to the design of the scissor retaining straps 16 and 18. The width of the device 10 may be 1 to 4 inches with the most common width being 1 to 2 inches. As the scissors 12 fall, the scissor retaining straps 16 and 18 pull the finger holes of the scissors 12 together such that the points of the scissors 12 close when the scissor retaining straps 16 and 18 reach the end of their travel. This helps prevent the sharp edges of the blades or the sharp individual points of the scissors 12 from striking those persons in proximity to the falling scissors. This also helps prevent the person wearing the apparatus from cutting their fingers. Finally, since the scissors are easily damaged when they strike the ground, the retaining straps 16 and 18 provide for a secure retention of the scissors to prevent them from striking the ground.

The wrist portion 14 of the scissor retaining device 10 includes a detachable scissor sheath 38 that provides a pocket for inserting the points of the scissors.

Figure 4:
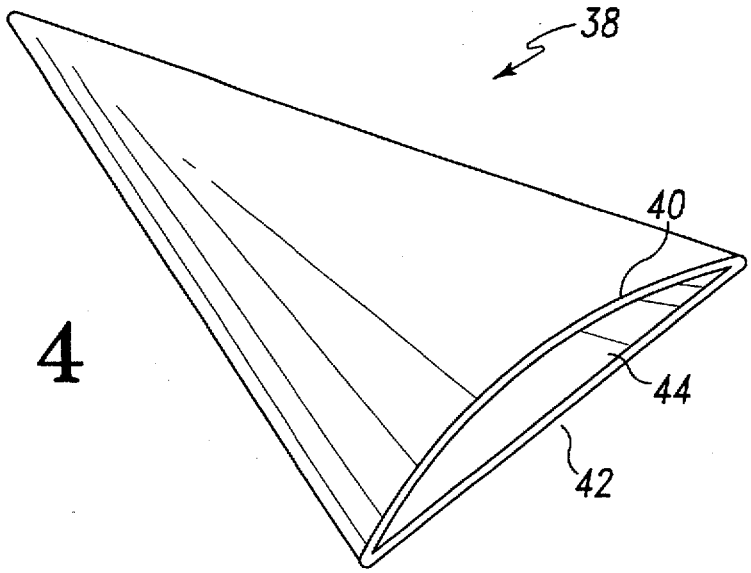
FIG. 4 is a perspective view of the scissor sheath showing the pocket into which the scissors are placed.

Referring now to FIG. 4, a perspective view of the scissor sheath 38 is shown. A first piece of material 40 and a second piece of material 42 are joined together either by adhesive or by sewing the edges together such that a triangular shaped pocket 44 is formed for inserting the sharp points of a closed pair of scissors 12. The first piece of material 40 and the second piece of material 42 may be made of a piece of resilient or elastic material such as closed cell neoprene foam, in the preferred form, or some other material such as leather or nylon in alternative forms. In the preferred form, the material is covered by a fabric layer such as Nylon Tricot on one or both sides to provide comfort and aesthetic value. The scissor sheath 38 provides a protective cover for the points of the scissors 12 that serves to protect the scissors 12 and to provide additional safety by providing cushion in the event the scissors 12 come into contact with a nearby person.

Figure 5:
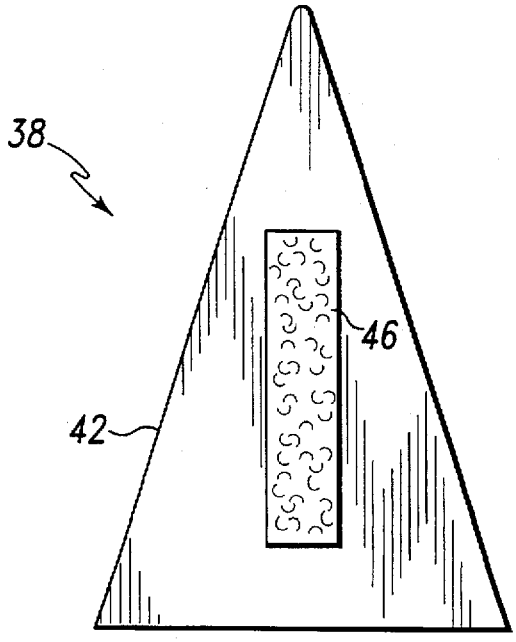
FIG. 5 is a rear, plan view of the scissor sheath showing the hook portion of a hook and loop assembly.

Referring now to FIG. 5, a rear view of the scissor sheath 38 is shown. The underside of material 42 is shown with a sheath hook portion 46. The sheath hook portion 46 can be attached to wrist loop portion 22 shown in FIG. 3 to act as a holding device for the wearer to conduct other activities such as answering the telephone or taking a short break. In this manner, the scissors 12 remain secured and are not allowed to hang freely from the wrist. Furthermore, the scissor sheath 38 is easily detachable from the wrist portion 14 for continued use. When in use, the scissor sheath 38 is removed and placed on the wrist loop portion 22 to prevent loss and the scissor sheath 38 is conveniently available for the next use.

In alternative embodiments, the scissor sheath 38 may be more permanently attached to the wrist portion 14 by means of adhesive or by sewing the scissor sheath 38 to the wrist portion 14 along the edges.

Figure 6:
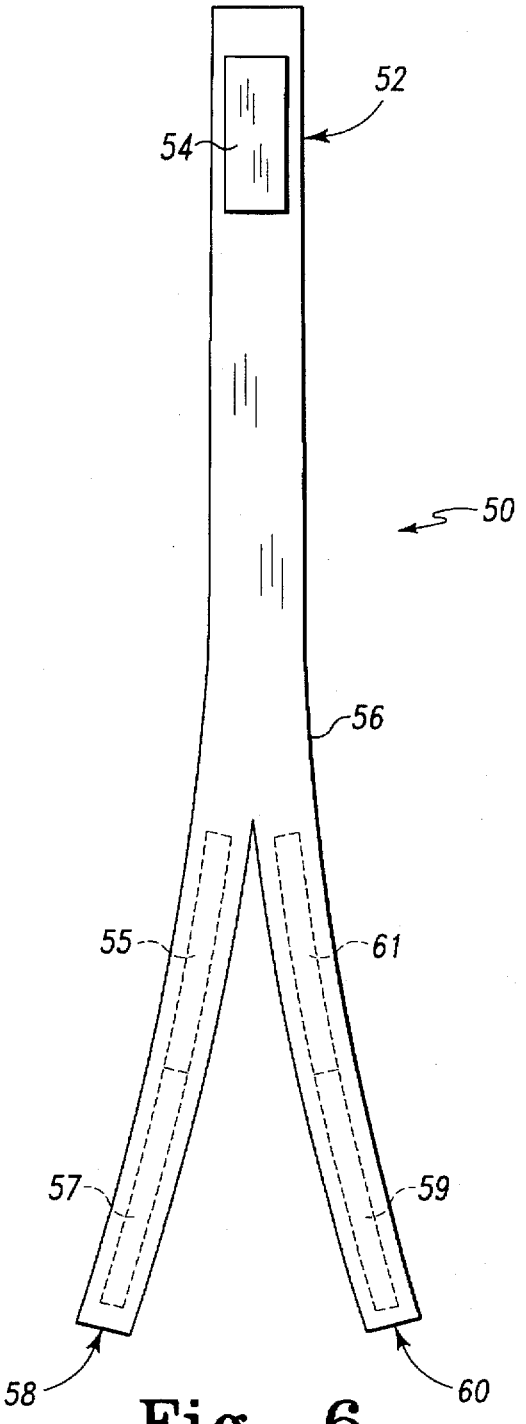
FIG. 6 is a top, plan view of a second embodiment of the scissor retaining device with a belt loop portion.

Referring now to FIG. 6, a top, plan view of a second embodiment of the scissor retaining device 50 with a belt loop portion 52 is shown. The scissor retaining device 50 is comprised of a band of material 56 with a belt loop portion 52 at one end and scissor retaining straps 58 and 60 at the opposite end. The band of material 56 may be made of a piece of resilient or elastic material such as closed cell neoprene foam, in the preferred form, or some other material such as leather or nylon in alternative forms. In the preferred form, the material is covered by a fabric layer such as Nylon Tricot on one or both sides to provide comfort and aesthetic value. In this embodiment, the scissor retaining straps 58 and 60 remain similar to the previous embodiment and are attached to the finger holes of scissors 12 in a similar manner. The scissor retaining straps 58 and 60 are secured individually to each of the finger holes in the scissors 12 by means of a hook and loop assembly. The scissor retaining strap 58 is routed through one of the finger holes in the scissors 12. The scissor retaining strap 58 comprises a strap loop portion 55 at the end of the scissor retaining strap 58 and a strap hook portion 57 directly adjacent to the strap loop portion 55. The strap loop portion 55 and the strap hook portion 57 must be attached to scissor retaining strap 58. This may be accomplished by using adhesives or by sewing the strap loop portion 55 and strap hook portion 57 to the scissor retaining strap 58. The scissor retaining strap 58 passes through the finger hole such that the strap hook portion 57 is pulled through the finger hole and folded back onto the strap loop portion 55 and a secure closure is attained. The material thickness in the finger holes created from passing the scissor retaining strap 58 through the finger hole provides the added benefit of snugging the person's fingers within the finger holes without causing an undue amount of abrasion or discomfort on the fingers. In a similar manner, scissor retaining strap 60 is also secured about the other fingerhole in the pair of scissors 12. The scissor retaining strap 60 passes through the remaining finger hole such that the strap loop portion 61 is pulled through the finger hole and folded back onto the strap hook portion 59 and a secure closure is attained. The length of the retaining straps may be adjusted by pulling each of the straps through the finger holes until the desired length is reached. The strap loop portions 55 and 61 and the strap hook portions 57 and 59 may be attached along the entire length of the scissor retaining straps 58 and 60 to provide maximum adjustability. Attached to the belt loop portion 52 is a belt receiving loop 54 through which a belt can be routed to secure the scissor retaining device 50. This embodiment can be used by those who find the strap around the wrist to be annoying or uncomfortable.

Figure 7:
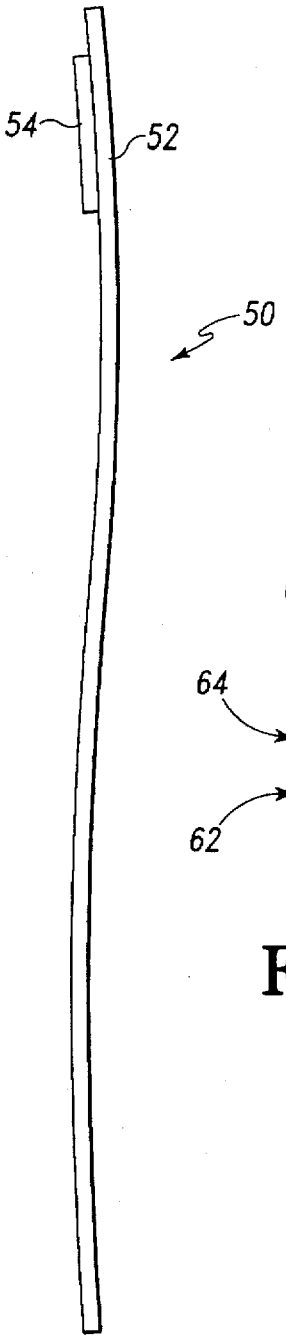
FIG. 7 is a side view of a second embodiment of the scissor retaining device with a belt loop portion.

Referring now to FIG. 7, a side view of a second embodiment of the scissor retaining device 50 with a belt loop portion 52 and a belt receiving loop 54 is shown.

Figure 8:
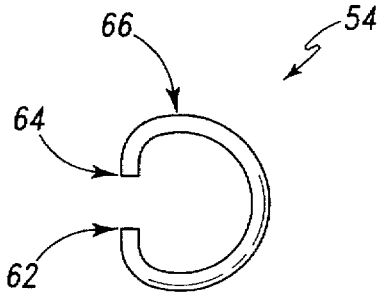
FIG. 8 is a side view of the belt receiving portion.

Referring now to FIG. 8, a side view of the belt receiving loop 54 is shown. The belt receiving loop 54 consists of a single piece of material 66, the ends 62 and 64 of which are looped to meet each other and form the elliptical belt receiving loop 54. The ends 62 and 64 are attached to the belt loop portion 52 by adhesives or by sewing the ends to the belt loop portion 52 or by a hook and loop assembly similar to that previously described. After attachment, a closed elliptical belt receiving loop 54 is formed for receiving a belt (not shown). The single piece of material 66 may be made of a piece of resilient or elastic material such as closed cell neoprene foam, in the preferred form, or some other material such as leather or nylon in alternative forms. In the preferred form, the material is covered by a fabric layer such as Nylon Tricot on one or both sides to provide comfort and aesthetic value.

Other embodiments of the scissor retaining device 10 may include replacing the belt loop portion 52 with a hook such that the device 10 could be hooked over a belt or attached to a bracelet by placing the hook over the bracelet.

Other modifications may be made without departing from the ambit of the invention, the nature of which, is to be determined from the foregoing description and the appended claim.

What is claimed is:

1. A scissor retaining device for a pair of scissors having finger holes at one end and a point at the other end, said device comprising:

(a) a band of material;

(b) a wrist portion at one end of said band for disposing about the wrist of a person;

(c) a wrist securing means for securing said wrist portion of said band to the wrist of a person;

(d) a retaining strap portion extending substantially parallel from the opposite end of said band for disposing about the finger holes of a pair of scissors;

(e) a retaining strap securing means for securing said retaining strap portion to the finger holes of a pair of scissors;

(f) a first piece of triangular material and a second piece of triangular material of a similar shape, joined together to form a sheath for placement over the point of the scissors and secured to said wrist portion; and (g) a sheath securing means for securing said sheath to said wrist portion.

2. The scissor retainer of claim 1 wherein each of the wrist portion securing means, the retaining strap securing means and the sheath securing means comprising a hook and loop assembly.

3. The scissor retainer of claim 1 wherein the wrist portion securing means comprising:

a) a securing loop affixed to the band at the one end;

b) a wrist loop portion attached to said wrist portion adjacent to said securing loop;

c) a wrist hook portion attached to said wrist portion adjacent to said wrist loop portion; and d) said scissor retaining straps passing through said securing loop until said wrist hook portion is folded back and over said wrist loop portion.

* * * * *